US009116463B2

(12) United States Patent
Handa et al.

(10) Patent No.: US 9,116,463 B2
(45) Date of Patent: Aug. 25, 2015

(54) SEAL CONFIGURATION FOR SUPPRESSING DEVELOPER LEAKAGE IN A DEVELOPING DEVICE

(71) Applicants: Hiroshi Handa, Inazawa (JP); Soun Kanada, Nagoya (JP)

(72) Inventors: Hiroshi Handa, Inazawa (JP); Soun Kanada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 15 days.

(21) Appl. No.: 14/091,941

(22) Filed: Nov. 27, 2013

(65) Prior Publication Data

US 2014/0153961 A1 Jun. 5, 2014

(30) Foreign Application Priority Data

Nov. 30, 2012 (JP) ..... 2012-263427

(51) Int. Cl.
*G03G 15/08* (2006.01)

(52) U.S. Cl.
CPC ..... *G03G 15/0817* (2013.01)

(58) Field of Classification Search
CPC ..... G03G 15/0817; G03G 15/0812; G03G 15/0898
USPC ..... 399/103, 105
See application file for complete search history.

(56) References Cited

U.S. PATENT DOCUMENTS

| | | | | |
|---|---|---|---|---|
| 7,912,402 | B2 * | 3/2011 | Mori | 399/103 |
| 8,041,250 | B2 * | 10/2011 | Matsushita | 399/103 |
| 2005/0180774 | A1 * | 8/2005 | Ohgoshi et al. | 399/103 |
| 2007/0071490 | A1 * | 3/2007 | Nakaya et al. | 399/103 |
| 2010/0092206 | A1 * | 4/2010 | Matsushita et al. | 399/103 |

FOREIGN PATENT DOCUMENTS

JP 2010-054829 A 3/2010

* cited by examiner

*Primary Examiner* — Sophia S Chen
(74) *Attorney, Agent, or Firm* — Banner & Witcoff, Ltd.

(57) ABSTRACT

A developing device including: a first seal member arranged between a housing and a layer thickness regulation blade, and a second seal member arranged between the housing and a developing roller, wherein the first seal member is arranged adjacent to the second seal member in a rotating direction of the developing roller, wherein the second seal member includes a first member contacting a circumferential surface of the developing roller and a second member arranged between the housing and the first member, wherein the second member includes a protruding portion that, in the rotating direction of the developing roller, protrudes more towards the first seal member than the first member, and wherein end portions of the first and second members in the rotating direction of the developing roller are respectively configured to contact with the first seal member.

5 Claims, 10 Drawing Sheets

(RELATED ART)

(RELATED ART)

SEAL CONFIGURATION FOR SUPPRESSING DEVELOPER LEAKAGE IN A DEVELOPING DEVICE

CROSS-REFERENCE TO RELATED APPLICATIONS

This application claims priority from Japanese Patent Application No. 2012-263427 filed on Nov. 30, 2012, the entire contents of which are incorporated herein by reference.

TECHNICAL FIELD

Aspects of the invention relate to a developing device having a side seal, an upper seal and a layer thickness regulation blade.

BACKGROUND

In general, a developing device has been known which has a housing, a developing roller, a layer thickness regulation blade and a side seal arranged between the housing and the developing roller at an end portion of the developing roller (see JP-A-2010-54829). By arranging the side seal, a gap is not formed between the housing and the end portion of the developing roller.

Also, the developing device of JP-A-2010-54829 has an upper seal between the housing and the layer thickness regulation blade. The upper seal is arranged so that it is pressed to the layer thickness regulation blade, and is configured so that a gap is not formed between the housing and the layer thickness regulation blade. The upper seal contacts with an end surface of the side seal before the layer thickness regulation blade is mounted. That is, the upper seal is arranged so that a gap is not formed between the upper seal and the side seal.

SUMMARY

However, when the layer thickness regulation blade is mounted to the housing, the upper seal is pressed by the layer thickness regulation blade. Therefore, the end surface of the side seal may be dragged by the upper seal at a contact part of the upper seal and the end surface of the side seal. In this case, a gap is easily formed at the contact part of the upper seal and the end surface of the side seal and developer may thus leak through the gap.

Accordingly, aspects of the invention provide a developing device capable of suppressing developer from leaking.

According to an aspect of the present invention, there is provided a developing device including: a housing configured to accommodate developer therein; a developing roller rotatably provided to the housing; a plate-shaped layer thickness regulation blade configured to contact with the developing roller and regulate a layer thickness of the developer on the developing roller; a first seal member arranged between the housing and the layer thickness regulation blade, and a second seal member arranged between the housing and the developing roller at an end portion of the developing roller in an axis line direction of the developing roller, wherein the first seal member is arranged adjacent to the second seal member in a rotating direction of the developing roller, wherein the second seal member includes a first member contacting a circumferential surface of the developing roller and a second member arranged between the housing and the first member, wherein the second member includes a protruding portion that, in the rotating direction of the developing roller, protrudes more towards the first seal member than the first member, and wherein end portions of the first member and the second member in the rotating direction of the developing roller are respectively configured to contact with the first seal member.

According to the above configuration, even when the layer thickness regulation blade is mounted, since the end portions of the first member and the second member are contacted to the first seal member, it is possible to suppress a gap from being formed between the first seal member and the first member. Hence, it is possible to suppress leakage of the developer.

DETAILED DESCRIPTION

Hereinafter, an illustrative embodiment of the invention will be specifically described with reference to the drawings. Meanwhile, hereinafter, an overall configuration of a laser printer according to an illustrative embodiment of the invention will be first described and features of the invention will be then specifically described.

Meanwhile, in the following descriptions, directions are described based on a user who is using the laser printer. That is, in FIG. 1, the left side is referred to as the 'front side', the right side is referred to as the 'rear side', the inner side is referred to as the 'left side' and the front side is referred to as the 'right side.' Also, the upper and lower directions are referred to as the 'upper-lower direction.'

<Schematic Configuration of Laser Printer>

Figure 1:
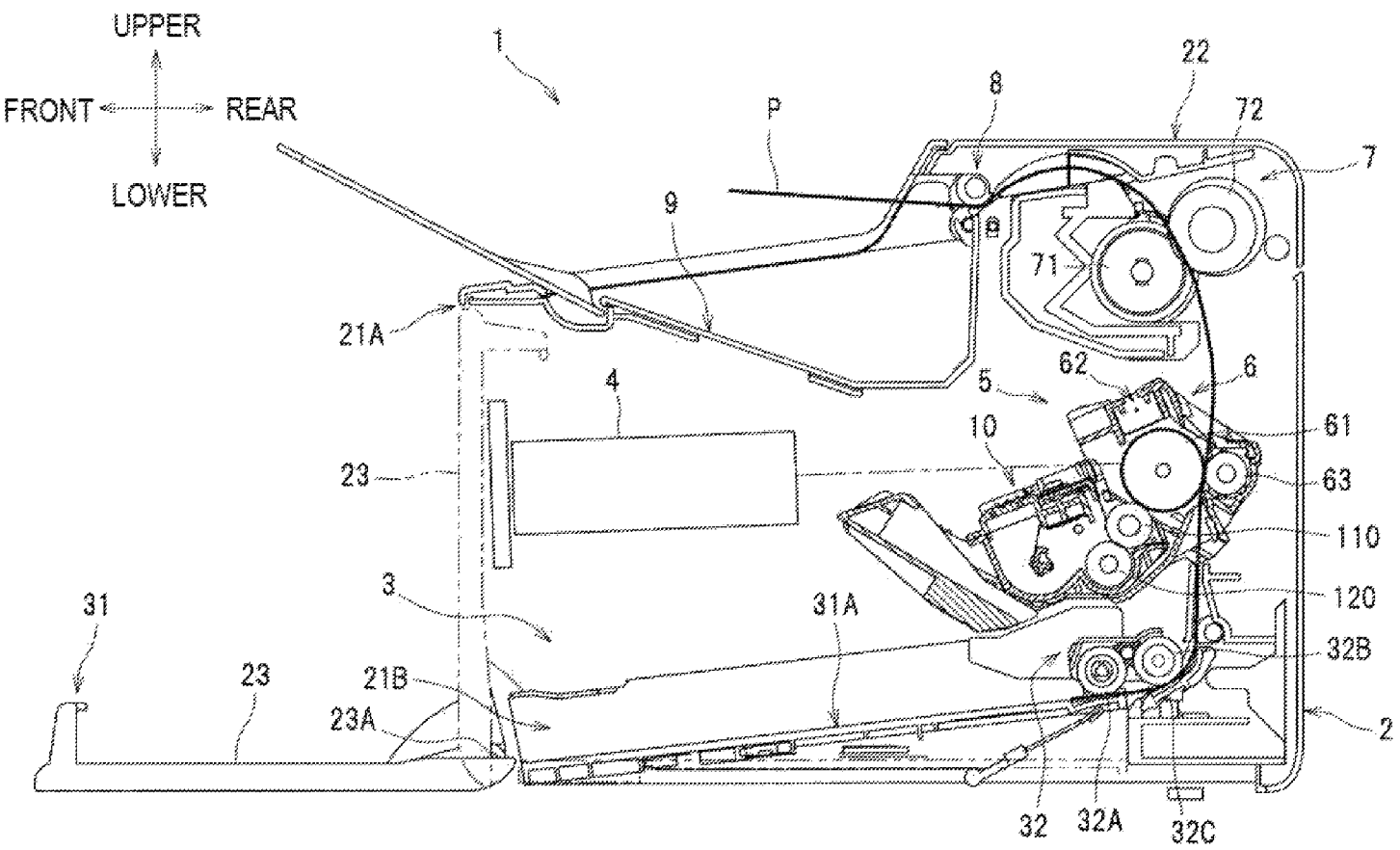
FIG. 1 is a sectional view of a laser printer having a developing cartridge according to an illustrative embodiment of the invention.

As shown in FIG. 1, a laser printer 1 mainly has an apparatus main body 2, a feeder unit 3 for feeding a sheet P, a scanner unit 4, a process cartridge 5 that transfers a toner image onto the sheet P and a fixing device 7 that heat-fixes the toner image on the sheet P.

The apparatus main body 2 has a top cover 22 and a front cover 23. Also, the apparatus main body 2 is formed at its upper part with an opening 21A for attaching and detaching the process cartridge 5 and at its front side part with an insertion opening 21B for inserting the sheet P.

The front cover 23 has a rotary shaft 23A that is provided at a front-lower part of the apparatus main body 2, and is thus configured to rotate forwards about the rotary shaft 23A. Incidentally, in FIG. 1, the front cover 23 shown with a dashed-two dotted line shows a state where the front side of the apparatus main body 2 is closed and the front cover 23 shown with a solid line shows a state where the front side of the apparatus main body 2 is opened.

The feeder unit 3 is located at a lower part of the apparatus main body 2 and has a sheet feeding tray 31 for placing the sheet P thereon and a sheet feeding mechanism 32 that feeds the sheet P on the sheet feeding tray 31.

The sheet feeding tray 31 is configured by a placing member 31A arranged at the lower part of the apparatus main body 2 and the front cover 23.

The sheet feeding mechanism 32 mainly has a feeder roller 32A, a separation roller 32B and a separation pad 32C. The feeder roller 32A is arranged above a rear end of the placing member 31A at an upstream side of the separation roller 32B in a conveying direction of the sheet P. The separation roller 32B is arranged to face the separation pad 32C.

The feeder unit 3 is configured so that the front cover 23 is brought down forwards to form the sheet feeding tray 31 and the sheet P can be then put on the sheet feeding tray 31. The feeder roller 32A is rotated while contacting the sheet P placed on the sheet feeding tray 31, so that the sheet P placed on the sheet feeding tray 31 is delivered to the separation roller 32B. The delivered sheet P is separated one by one between the separation roller 32B and the separation pad 32C and is then conveyed towards the process cartridge 5.

The scanner unit 4 is provided at the front side in the apparatus main body 2 and has a laser light emitting unit, a polygon mirror, a lens, a reflector and the like, which are not shown. The scanner unit 4 illuminates a laser beam on a surface of a photosensitive drum 61 (which will be described later) by a high-speed scanning.

The process cartridge 5 is positioned in the vicinity of a rear-central part of the apparatus main body 2 and is provided above the sheet feeding mechanism 32. The process cartridge 5 is configured so as to be detachable from the apparatus main body 2 towards the upper-front through the opening 21A, and has a drum unit 6 and a developing cartridge 10 that is an example of the developing device.

Figure 2:
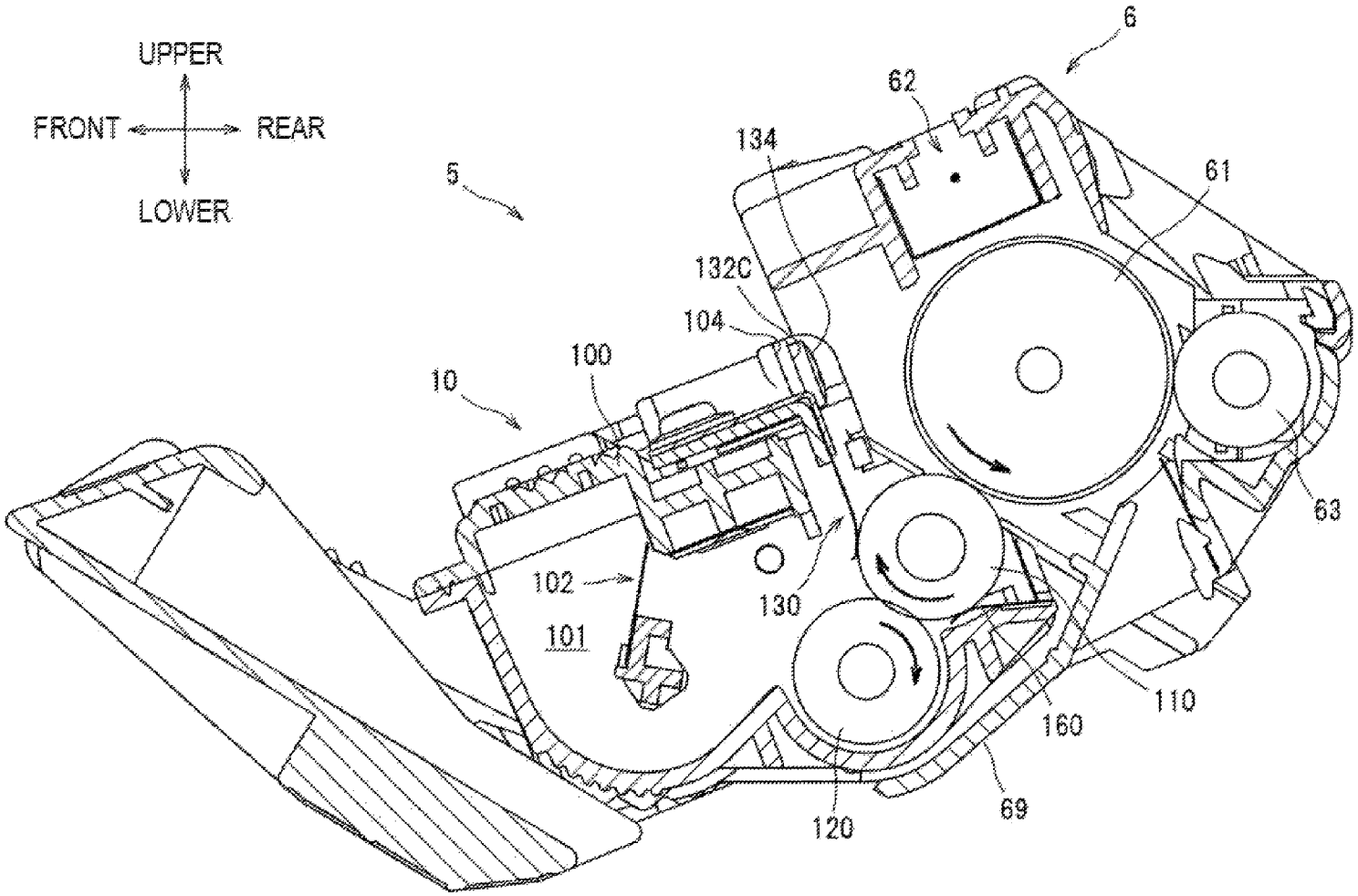
FIG. 2 is an enlarged view showing the developing cartridge according to the illustrative embodiment of the invention.

As shown in FIG. 2, the drum unit 6 has a drum frame 69 and a photosensitive drum 61, a charger 62 and a transfer roller 63 provided to the drum frame 69.

The developing cartridge 10 has a housing 100, a developing roller 110, a supply roller 120 and a layer thickness regulation blade 130 and is configured so as to be detachable from the drum unit 6. The housing 100 and the layer thickness regulation blade 130 will be specifically described later.

The developing roller 110 is a member configured to carry toner on a circumferential surface thereof and is rotatably mounted to the housing 100.

The supply roller 120 is a member configured to supply the toner attached on a circumferential surface thereof to the circumferential surface of the developing roller 110, and is arranged at a front lower side of the developing roller 110.

In the developing cartridge 10, the toner accommodated in a toner accommodation chamber 101 formed in the housing 100 is stirred by an agitator 102 and is then supplied to the developing roller 110 by the supply roller 120. At this time, the toner is positively friction-charged between the supply roller 120 and the developing roller 110. As the developing roller 110 is rotated, the toner supplied onto the developing roller 110 is introduced between the layer thickness regulation blade 130 and the developing roller 110 and is then carried on the developing roller 110 as a thin film having a predetermined thickness with being further friction-charged therebetween.

In the drum unit 6, a surface of the photosensitive drum 61 being rotated is uniformly charged by the charger 62 and is then exposed by the high-speed scanning of the laser beam emitted from the scanner unit 4. Thereby, a potential of the exposed part is lowered and an electrostatic latent image based on image data is thus formed on the surface of the photosensitive drum 61.

Then, the toner is supplied from the developing cartridge 10 to the electrostatic latent image, so that a toner image is formed on the surface of the photosensitive drum 61. After that, the sheet P is conveyed between the photosensitive drum 61 and the transfer roller 63, so that the toner image carried on the surface of the photosensitive drum 61 is transferred onto the sheet P.

Returning back to FIG. 1, the fixing device 7 is positioned at the upper-rear side of the apparatus main body 2 and is arranged above the process cartridge 5. The fixing device 7 mainly has a heating roller 71 and a pressing roller 72.

The heating roller 71 is a member that heats the sheet P, and is provided therein with a heat source (not shown) such as halogen lamp and the like.

The pressing roller 72 is a member that conveys the sheet P between the heating roller 71 and the pressing roller 72, and is provided obliquely upwards at the rear of the heating roller 71.

The fixing device 7 configured as described above heat-fixes the toner transferred on the sheet P while the sheet P passes between the heating roller 71 and the pressing roller 72. In the meantime, the sheet P heat-fixed by the fixing device 7 is conveyed towards a discharge roller 8 provided at a downstream side of the fixing device 7 and is discharged onto a discharge tray 9 from the discharge roller 8.

<Detailed Configuration of Developing Cartridge>

Subsequently, the configuration of the developing cartridge 10 will be described.

Figure 3:
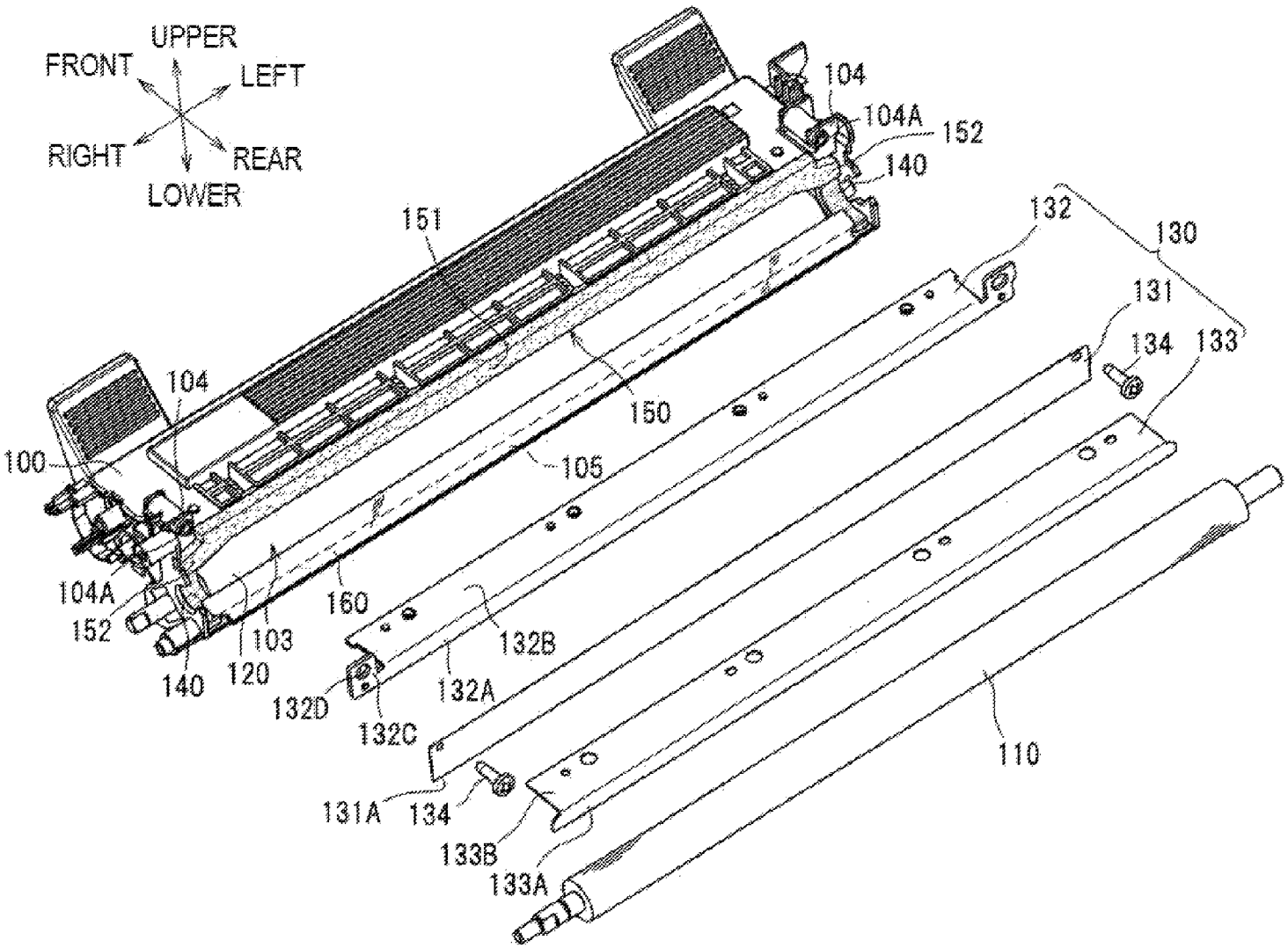
FIG. 3 is an exploded perspective view of the developing cartridge.

As shown in FIG. 3, the housing 100 is formed at its rear sidewall with an opening 103, and the developing roller 110 and the layer thickness regulation blade 130 are mounted thereto to close the opening 103. The opening 103 is provided on the left, right, top and bottom thereof with side seal members 140, which are an example of the second seal member, an upper seal member 150, which is an example of the first seal member, and a film 160 so as to prevent the toner in the housing 100 from leaking. Also, the opening 103 is formed at both end portions of an upper edge thereof with support surfaces 104 for fixing the layer thickness regulation blade 130. The side seal member 140 will be specifically described later.

Figure 6:
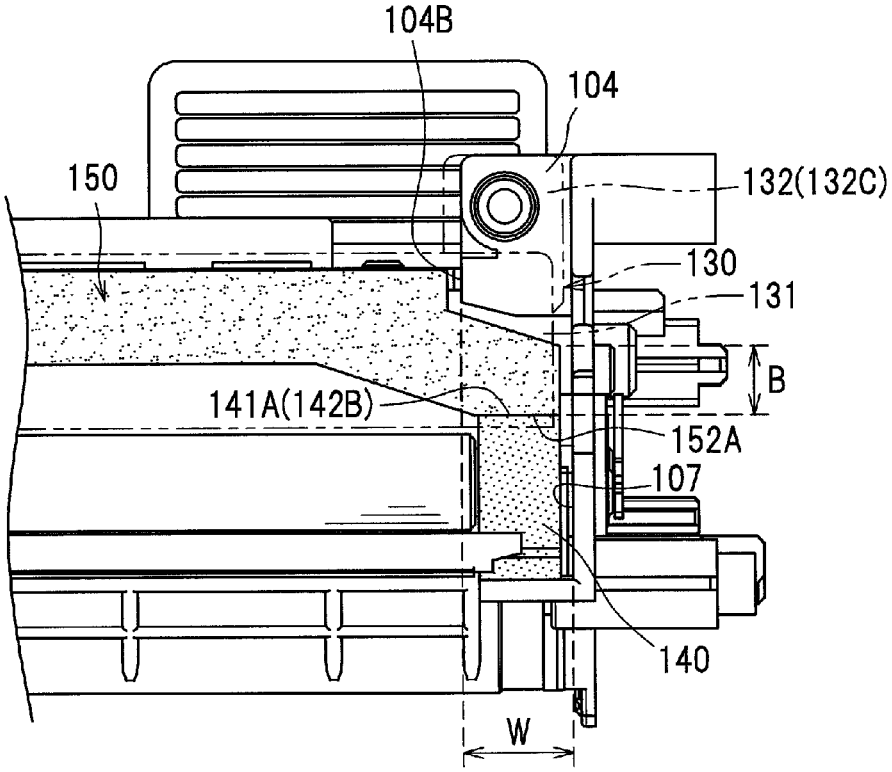
FIG. 6 is an enlarged view showing a surrounding of a support surface of the developing cartridge before the layer thickness regulation blade is mounted.

The support surfaces 104 are provided at both left and right end portions of the upper edge of the opening 103 and face the developing roller 110 (i.e., the rear side). The support surface 104 protrudes more rearwards than an attachment surface 106 of the upper seal member 150 in a front-rear direction of the housing 100 (refer to FIG. 4). The support surface 104 is formed with a hole 104A for inserting a screw 134 which will be described later. The hole 104A is positioned slightly nearer a center in a left-right direction and is also arranged nearer to the upper side on the support surface 104. Also, as shown in FIG. 6, the support surface 104 is formed so that a length thereof in the left-right direction becomes a range W. The range W indicates a range from an inner end portion 104B of the support surface 104 in the left-right direction to an inner surface 107 of the sidewall of the housing 100 in the left-right direction.

The layer thickness regulation blade 130 has a blade main body 131, a blade holder 132 and a reinforcement plate 133.

The blade main body 131 is configured by a metal plate such as stainless steel and has a leading end portion 131A that is bent in an opposite direction than the developing roller 110 (refer to FIG. 2). The leading end portion 131A contacts with the developing roller 110, so as to regulate a layer thickness of the toner on the developing roller 110.

The blade holder 132 has a blade support part 132A for supporting the blade main body 131, a reinforcement part 132B for attaching the reinforcement plate 133 and attachment parts 132C for attachment to the support surfaces 104. The attachment part 132C is formed with a hole 132D. The blade holder 132 is formed so that the reinforcement part 132B is bent forwards at a substantially right angle from an upper end of the blade support part 132A.

The reinforcement plate 133 has a holding part 133A for holding the blade main body 131 between the blade holder 132 and the reinforcement plate 133 and a fixing part 133B for fixing the reinforcement plate 133 to the blade holder 132. The reinforcement plate 133 is formed so that the holding part 133A is bent downwards at a substantially right angle from a rear end of the fixing part 133B.

The layer thickness regulation blade 130 is configured into an integral component by holding the blade main body 131 between the blade support part 132A of the blade holder 132 and the holding part 133A of the reinforcement plate 133 and fastening the reinforcement part 132B of the blade holder 132 and the fixing part 133B of the reinforcement plate 133 by screws (not shown). The layer thickness regulation blade 130 configured in this way is fixed to the housing 100 by enabling the screws 134 to pass through the holes 132D of the attachment parts 132C of the blade holder 132 and then to be screwed into the holes 104A formed in the support surfaces 104.

The upper seal member 150 is arranged between the housing 100 and the layer thickness regulation blade 130 and is made of a sponge material such as urethane foam, silicon sponge and the like. The upper seal member 150 has a central part 151 extending in the left-right direction and connection parts 152 extending obliquely downwards from both left and right end portions of the central part 151 and connecting to the side seal members 140. The central part 151 and the connection parts 152 are integrally formed.

As shown in FIG. 6, the connection part 152 is arranged between the side seal member 140 and the support surface 104 and has a lower edge portion 152A having a horizontal and straight line shape. The lower edge portion 152A contacts with an end surface 141A and an end surface 142B of the side seal member 140, so that the toner is prevented from leaking between the upper seal member 150 and the side seal member 140.

Figure 5A:
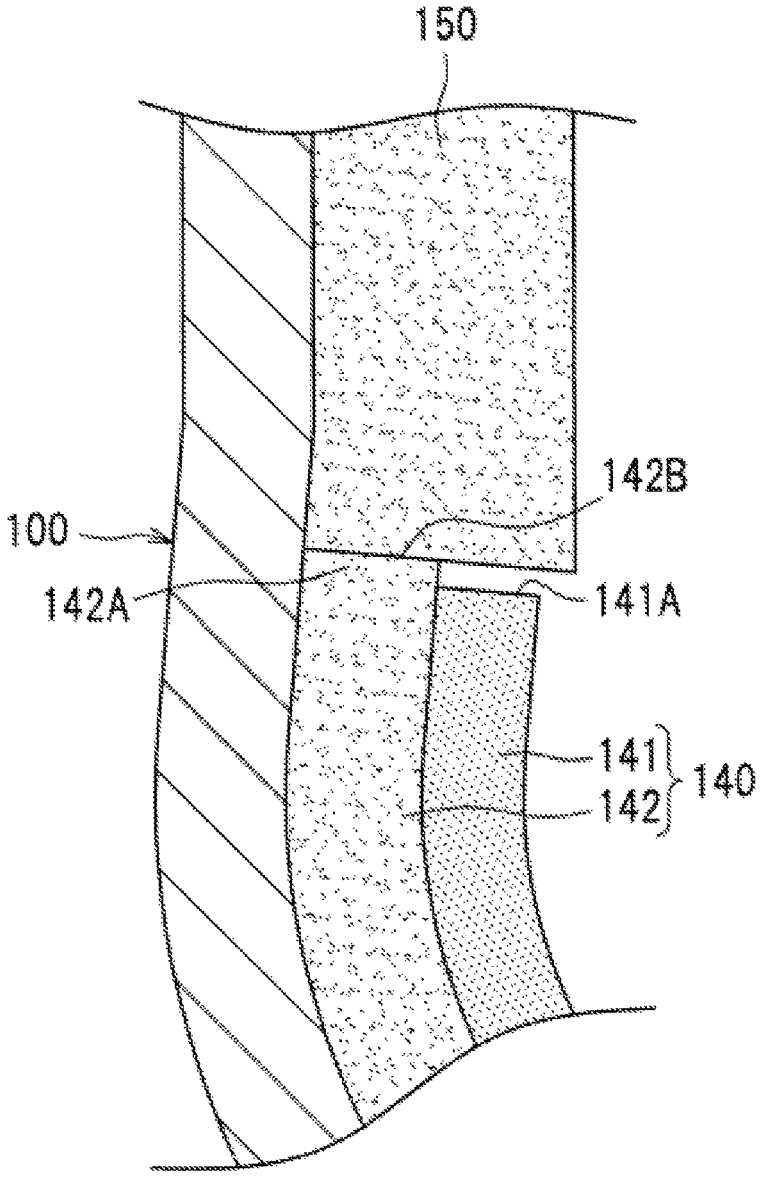
FIG. 5A is an enlarged view showing the surroundings of the right side seal member and the upper seal member of the developing cartridge before a layer thickness regulation blade is mounted and FIG. 5B is an enlarged sectional view showing the same after the layer thickness regulation blade is mounted.

A thickness of the upper seal member 150 is thicker than a thickness of the side seal member 140 before the layer thickness regulation blade 130 is mounted to the housing (refer to FIG. 5A). The thickness can be appropriately changed within a range in which a gap between a sliding contact member 141 and the upper seal member 150 can be filled, as described later.

Returning back to FIG. 3, the film 160 is arranged below the developing roller 110 and is made of PET (polyethylene terephthalate), acryl, fluorine resin and the like. The film 160 extends in the left-right direction and has a leading end portion that slidably contacts with the developing roller 110. The film 160 is attached to a film attachment part 105 extending in the left-right direction (refer to FIG. 4).

<Configuration of Side Seal Member>

Subsequently, the configuration of the side seal member 140 will be described.

Figure 4:
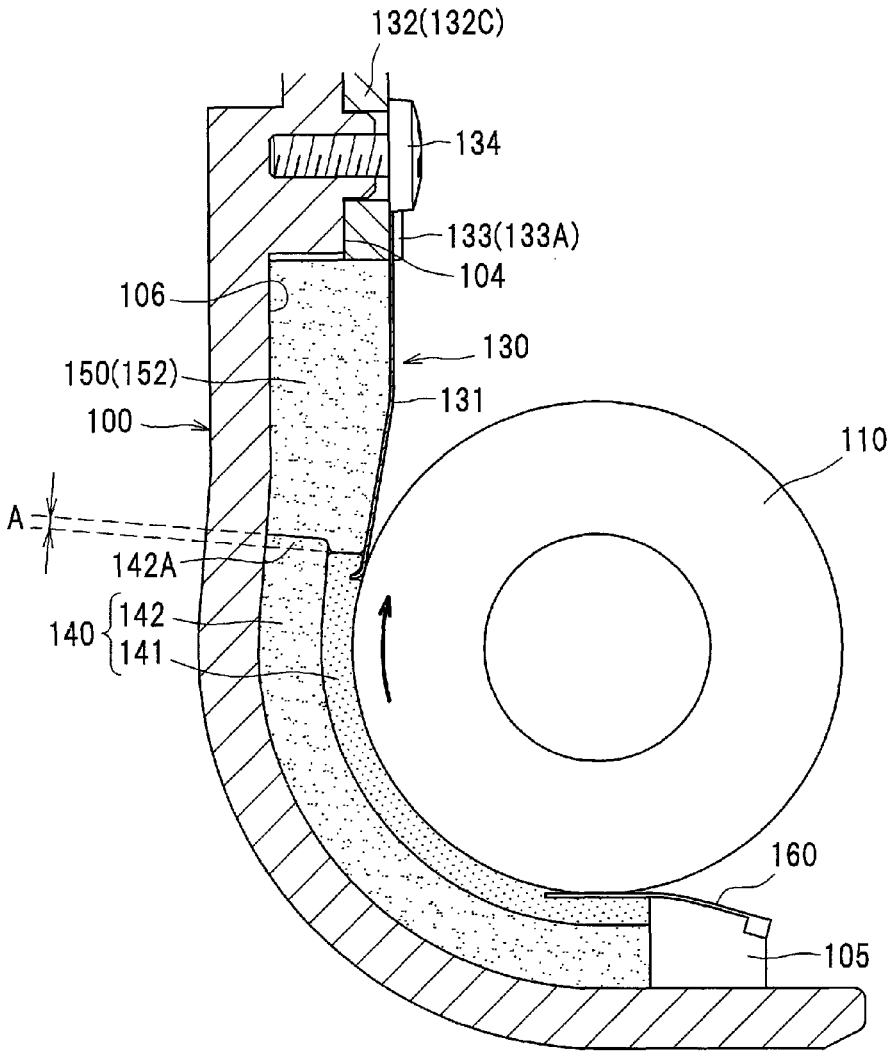
FIG. 4 is a sectional view showing surroundings of a right side seal member and an upper seal member of the developing cartridge.

The side seal member 140 is arranged between the housing 100 and the developing roller 110 at an end portion of the developing roller 110 in the left-right direction (the axis line direction). The side seal member 140 is adjacent to the upper seal member 150 in the rotating direction of the developing roller 110. As shown in FIG. 4, the side seal member 140 has a shape corresponding to the outer periphery shape of the developing roller 110 and has a sliding contact member 141 that is an example of the first member and a base material 142 that is an example of the second member.

The sliding contact member 141 is a member contacting with the circumferential surface of the developing roller 110 and has a fluff surface that is formed by weaving fiber such as PTFE (polytetrafluoroethylene), PET, acryl and nylon. As shown in FIG. 5A, before the layer thickness regulation blade 130 is mounted, the sliding contact member 141 is arranged so that the end surface 141A does not contact with the upper seal member 150.

The base material 142 is arranged between the housing 100 and the sliding contact member 141 and is made of a sponge material having a cushioning characteristic such as urethane foam and silicon sponge. The base material 142 has a protruding portion 142A that protrudes more towards the upper seal member 150 than the sliding contact member 141 in the rotating direction of the developing roller 110. The base material 142 is arranged at a position at which the end surface 142B (the end portion) contacts with the upper seal member 150 before and after the layer thickness regulation blade 130 is mounted.

As shown in FIGS. 4 and 6, the protruding portion 142A has a length A in the rotating direction (the upper-lower direction in the drawings) of the developing roller 110. The length A is shorter than a length B of the end portion of the connection part 152 of the upper seal member 150 in the rotating direction of the developing roller 110.

Figure 5B:
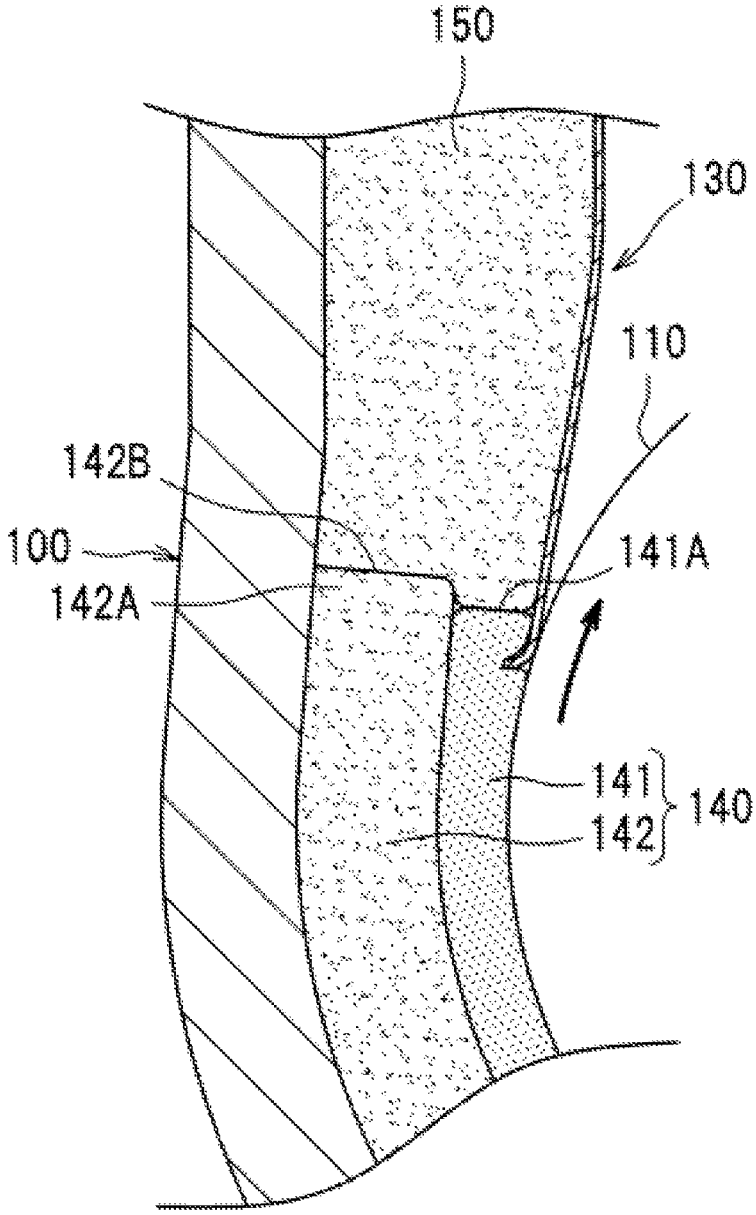

Further, as shown in FIG. 5B, at a state where the layer thickness regulation blade 130 is mounted, the upper seal member 150 contacts with the end surface 141A (the end portion) of the sliding contact member 141 in the rotating direction of the developing roller 110.

Figure 8A:
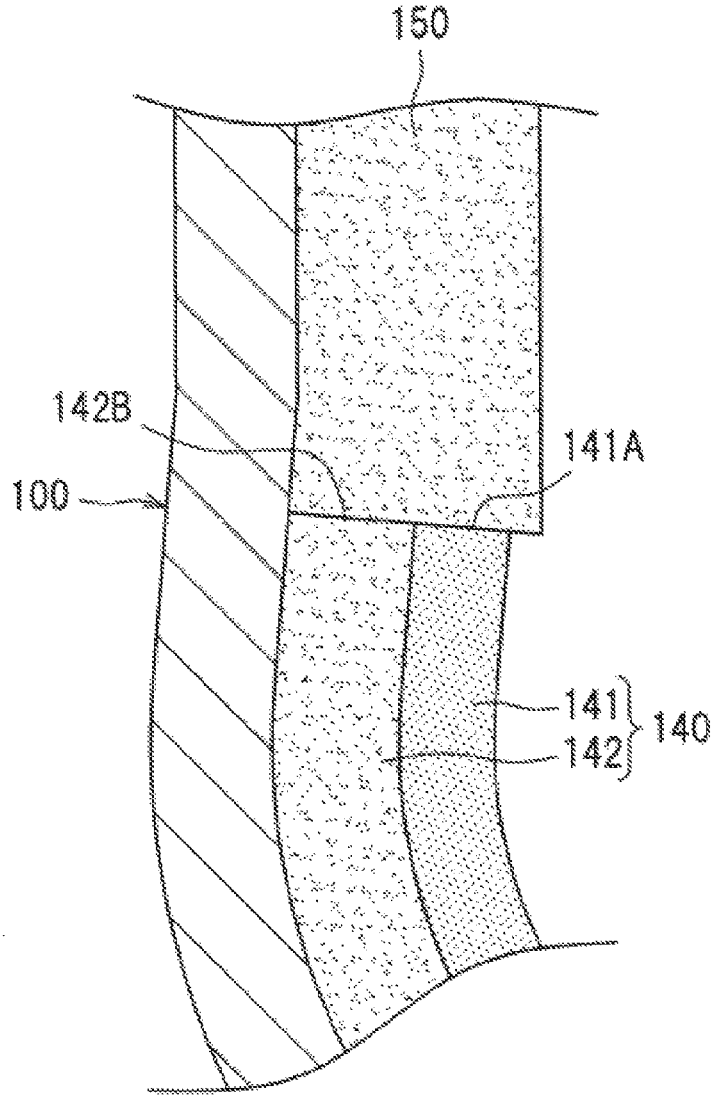
FIG. 8A shows a configuration of related art, which corresponds to FIG. 5A.
Figure 8B:
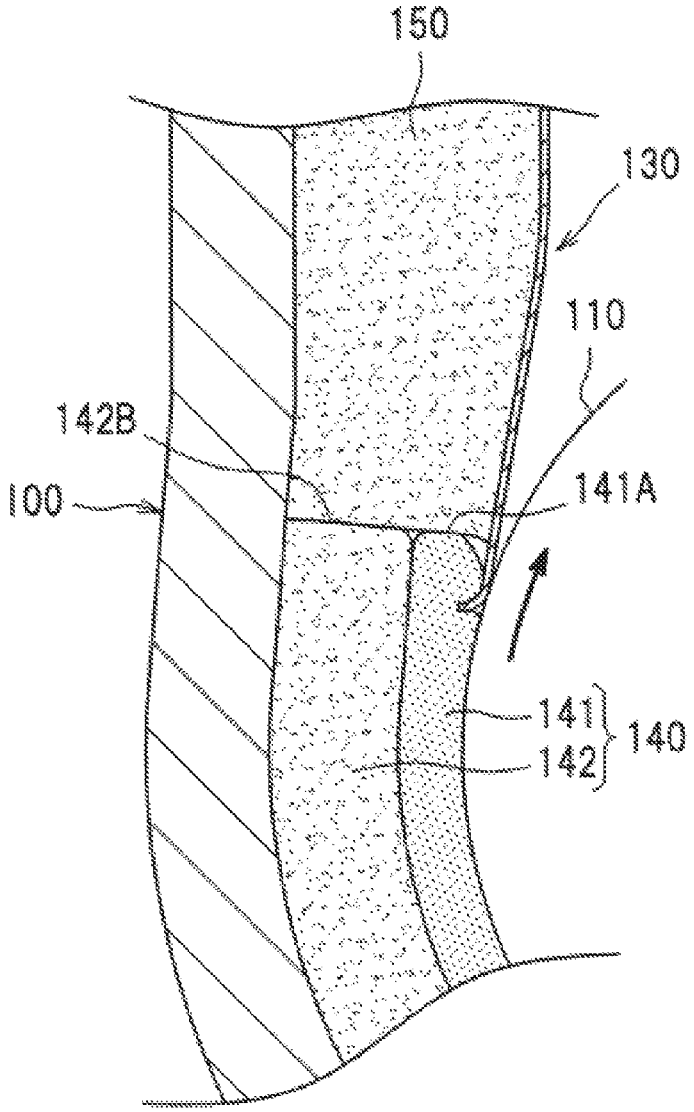
FIG. 8B shows a configuration of related art, which corresponds to equivalent to FIG. 5B.

Incidentally, according to the related art, as shown in FIG. 8A, the end surface 141A of the sliding contact member 141 of the side seal member 140 and the end surface 142B of the base material 142 contact with the upper seal member 150 before the layer thickness regulation blade 130 is mounted. In this configuration, as shown in FIG. 8B, when the layer thickness regulation blade 130 is mounted, the upper seal member 150 is pressed, so that the end surface 141A of the sliding contact member 141 is easily dragged by the upper seal member 150. As a result, a gap is easily formed between the upper seal member 150 and the side seal member 140.

In contrast, according to the developing cartridge 10 of this illustrative embodiment, as shown in FIG. 5A, since the base material 142 has the protruding portion 142A, the end surface 141A of the sliding contact member 141 does not contact with the upper seal member 150 before the layer thickness regulation blade 130 is mounted. In this configuration, when the layer thickness regulation blade 130 is mounted, the upper seal member 150 is pressed, as shown in FIG. 5B, so that the upper seal member 150 protrudes towards the end surface 141A of the sliding contact member 141 to thereby fill a gap between the upper seal member 150 and the sliding contact member 141. Thereby, it is possible to suppress a gap from being formed between the upper seal member 150 and the sliding contact member 141 and to thus suppress the toner from leaking through the gap.

Also, as shown in FIG. 6, in the left-right direction, the side seal member 140 is positioned within the range W in which the support surface 104 is arranged. The entire side seal member 140 in the left-right direction is positioned within a range of the attachment part 132C in the left-right direction.

Here, for example, if the support surface 104 is configured so that it is positioned at an outer side of the side seal member 140, the pressing force of the layer thickness regulation blade 130 becomes weaker as it is directed inwards. As a result, the upper seal member 150 may not be applied with a sufficient pressing force.

However, according to this illustrative embodiment, since the support surface 104 is arranged to overlap with the side seal member 140 in the left-right direction, the upper seal member 150 is pressed by a part of the layer thickness regulation blade 130, which is supported by the support surface 104 and thus can exhibit a sufficient pressing force. For this reason, compared to the configuration where the support surface 104 is arranged at the outer side of the side seal member 140 in the left-right direction, it is possible to suppress a gap from being formed between the upper seal member 150 and the sliding contact member 141 when mounting the layer thickness regulation blade 130 (refer to FIG. 5B). Here, in order to realize the effect, it is not necessarily required to arrange the entire side seal member 140 within the range W, and it is only necessary that at least a part of the side seal member 140 is positioned within the range W.

Although the illustrative embodiment of the invention has been described, the invention is not limited thereto. The specific configuration can be appropriately changed without departing from the scope of the invention.

Figure 7:
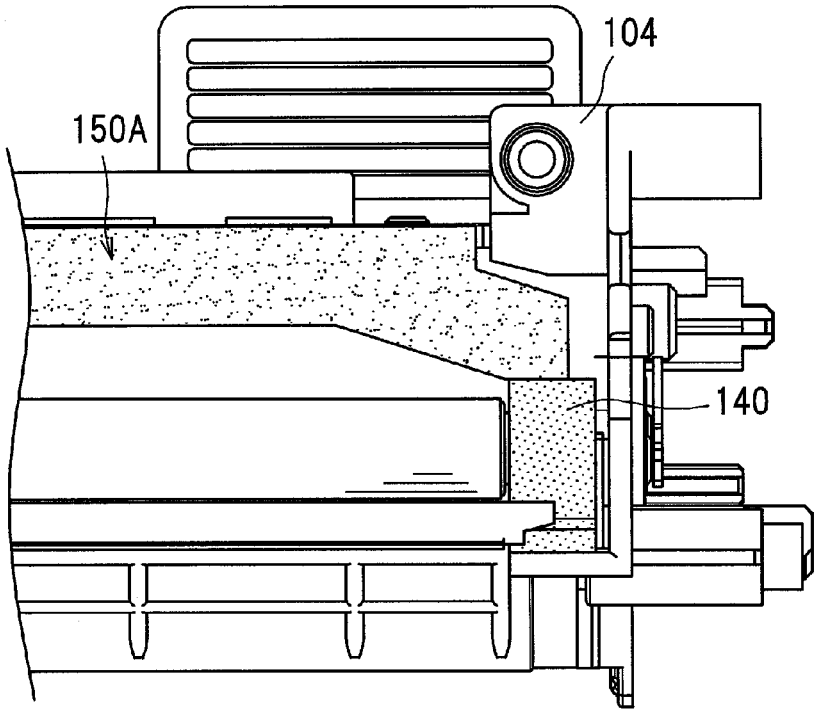
FIG. 7 shows a modified embodiment, which is equivalent to FIG. 6.

In the above-described illustrative embodiment, the upper seal member 150 is arranged so that the end portion thereof in the left-right direction is located at substantially the same position as the side seal member 140 in the left-right direction. However, the invention is not limited thereto. For example, like an upper seal member 150A shown in FIG. 7, an end portion of the upper seal member 150A may be arranged at an inner side of an outer end portion of the side seal member 140 in the left-right direction.

Even with the above configuration, it is possible to suppress a gap from being formed between the upper seal member 150A and the sliding contact member 141 as long as the upper seal member 150A and the end surface of the side seal member 140 contact with each other. Therefore, it is possible to shorten the upper seal member 150A, compared to the above-described illustrative embodiment, so that it is possible to reduce the cost.

In the above-described illustrative embodiment, in the left-right direction, the side seal member 140 is positioned within the range W in which the support surface 104 is arranged. However, if the upper seal member 150 is applied with sufficient pressing force from the layer thickness regulation blade 130, the side seal member 140 need not necessarily be positioned within the range W.

In the above-described illustrative embodiment, the side seal member 140 has the two-layered structure of the sliding contact member 141 and the base material 142. However, the side seal member 140 be structured by three or more layers.

In the above-described illustrative embodiment, the developing cartridge 10 has been exemplified as the developing device of the invention. However, the invention is not limited thereto. For example, the invention can be also applied to a so-called process cartridge having a photosensitive drum and a developing roller.

In the above-described illustrative embodiment, the invention has been applied to the laser printer 1. However, the invention is not limited thereto. That is, the invention can be also applied to the other image forming apparatuses, for example, a copier, a complex machine and the like.

The present invention provides illustrative, non-limiting aspects as follows:

(1) In a first aspect, there is provided a developing device including: a housing configured to accommodate developer therein; a developing roller rotatably provided to the housing; a plate-shaped layer thickness regulation blade configured to contact with the developing roller and regulate a layer thickness of the developer on the developing roller; a first seal member arranged between the housing and the layer thickness regulation blade, and a second seal member arranged between the housing and the developing roller at an end portion of the developing roller in an axis line direction of the developing roller, wherein the first seal member is arranged adjacent to the second seal member in a rotating direction of the developing roller, wherein the second seal member includes a first member contacting a circumferential surface of the developing roller and a second member arranged between the housing and the first member, wherein the second member includes a protruding portion that, in the rotating direction of the developing roller, protrudes more towards the first seal member than the first member, and wherein end portions of the first member and the second member in the rotating direction of the developing roller are respectively configured to contact with the first seal member.

Accordingly, even when the layer thickness regulation blade is mounted, since the end portions of the first member and the second member are contacted to the first seal member, it is possible to suppress a gap from being formed between the first seal member and the first member. Hence, it is possible to suppress leakage of the developer.

(2) In a second aspect, there is provided the developing device according to the first aspect, wherein, before the layer thickness regulation blade is mounted to the housing, a thickness of the first seal member is configured to be larger than a thickness of the second seal member.

(3) In a third aspect, there is provided the developing device according to the first or second aspect, wherein the housing has a support surface on which the layer thickness regulation blade is configured to be fixed, wherein the support surface faces towards the developing roller, and wherein, in the axis line direction, at least a part of the second seal member is positioned within a range in which the support surface is arranged.

Accordingly, since a part of the support surface is arranged to overlap with the second seal member in the axis line direction, a part of the layer thickness regulation blade exhibiting a strong pressing force can be arranged to overlap with the second seal member. Therefore, compared to a configuration where the support surface is arranged at an outer side of the second seal member in the axis line direction, it is possible to suppress a gap from being formed between the first seal member and the first member when mounting the layer thickness regulation blade.

(4) In a fourth aspect, there is provided the developing device according to the third aspect, wherein, in the axis line direction, the second seal member is positioned within the range in which the support surface is arranged.

(5) In a fifth aspect, there is provided the developing device according to one of the first to fourth aspects, wherein an end portion of the first seal member in the axis line direction is arranged at an inner side of an outer end portion of the second seal member in the axis line direction.

Accordingly, it is possible to shorten the first seal member.

What is claimed is:

1. A developing device comprising:

a housing configured to accommodate developer therein;

a developing roller rotatably provided to the housing;

a plate-shaped layer thickness regulation blade configured to contact the developing roller and regulate a layer thickness of the developer on the developing roller;

a first seal member arranged between the housing and the layer thickness regulation blade; and a second seal member arranged between the housing and the developing roller at an end portion of the developing roller in an axis line direction of the developing roller, wherein the first seal member is arranged adjacent to the second seal member in a rotating direction of the developing roller, wherein the second seal member includes a first member contacting a circumferential surface of the developing roller and a second member arranged between the housing and the first member, wherein the second member includes a protruding portion that, in the rotating direction of the developing roller, protrudes more towards the first seal member than the first member, and wherein end portions of the first member and the second member in the rotating direction of the developing roller are respectively configured to contact the first seal member.

2. The developing device according to claim 1, wherein, before the layer thickness regulation blade is mounted to the housing, a thickness of the first seal member is configured to be larger than a thickness of the second seal member.

3. The developing device according to claim 1, wherein the housing has a support surface on which the layer thickness regulation blade is configured to be fixed, wherein the support surface faces towards the developing roller, and wherein, in the axis line direction, at least a part of the second seal member is positioned within a range in which the support surface is arranged.

4. The developing device according to claim 3, wherein, in the axis line direction, the second seal member is positioned within the range in which the support surface is arranged.

5. The developing device according to claim 1, wherein an end portion of the first seal member in the axis line direction is arranged at an inner side of an outer end portion of the second seal member in the axis line direction.

* * * * *